US008402577B2

(12) United States Patent
Harrow

(10) Patent No.: US 8,402,577 B2
(45) **Date of Patent: *Mar. 26, 2013**

(54) EASY TO ASSEMBLE BED BASE, TWO-COMPONENT CONNECTOR AND KIT

(76) Inventor: Lawrence Harrow, Indian Wella, CA (US)

( * ) Notice: Subject to any disclaimer, the term of this patent is extended or adjusted under 35 U.S.C. 154(b) by 77 days.

This patent is subject to a terminal disclaimer.

(21) Appl. No.: 12/476,604

(22) Filed: Jun. 2, 2009

(65) Prior Publication Data

US 2009/0307842 A1 Dec. 17, 2009

Related U.S. Application Data

(63) Continuation of application No. 11/326,817, filed on Jan. 6, 2006, now abandoned, which is a continuation-in-part of application No. 11/197,759, filed on Aug. 4, 2005, now abandoned, which is a continuation of application No. 10/279,280, filed on Oct. 24, 2002, now Pat. No. 6,925,666.

(60) Provisional application No. 60/337,414, filed on Nov. 5, 2001.

(51) Int. Cl.
*A47C 19/00* (2006.01)

(52) U.S. Cl. ..... 5/288; 5/282.1; 5/201

(58) Field of Classification Search ..... 403/403, 403/205, 382, 402; 5/200.1, 201, 203, 288, 5/290, 299, 304, 282.1, 285, 286

See application file for complete search history.

(56) References Cited

U.S. PATENT DOCUMENTS 1,566,709 A 12/1925 Wasserman
1,915,215 A * 6/1933 Carpenter ..... 217/69
2,544,274 A 3/1951 Moeller
2,639,042 A 5/1953 Lambert et al.
2,721,338 A 10/1955 Resnick
3,123,837 A 3/1964 Paine et al.
3,605,142 A 9/1971 Weinhart
3,699,593 A 10/1972 Oetiker
3,713,181 A 1/1973 Hougland
3,730,108 A 5/1973 Stroh
3,744,068 A 7/1973 Harris
3,757,361 A 9/1973 Harris et al.
3,760,437 A 9/1973 Hooker
3,795,022 A 3/1974 Harris
3,803,644 A 4/1974 Harris
3,849,012 A 11/1974 Krouse
3,945,064 A 3/1976 Harris et al.
3,952,345 A 4/1976 Spitz
4,016,612 A * 4/1977 Barile, Sr. ..... 5/200.1
4,078,270 A 3/1978 Nowell
RE29,611 E 4/1978 Lawrence
4,106,141 A 8/1978 Hooker
4,196,484 A 4/1980 Harris (Continued)

OTHER PUBLICATIONS

U.S. Appl. No. 11/326,817, filed Jan. 6, 2006, Harrow.

(Continued)

*Primary Examiner* — Sunil Singh
(74) *Attorney, Agent, or Firm* — John J. Connors; Connors & Assoc. pc

(57) ABSTRACT

A bed base and bed base kit includes four side members, each being symmetrical about its longitudinal axis. The side members are assembled into a rectangular structure with the members positioned to stand vertically upright on their edges. Opposed side members are of the same length and are connected at adjacent ends by a two-component connector. A first component of the connector is attached to the opposed ends of each one of a first pair of opposing side members and a second component is attached to the opposed ends of each one a second pair of opposing side members. The second components are offset from the longitudinal axis of the one side member to which they re attached. Thus, when the side members are assembled to form the rectangular structure, the respective edges of the side members are substantially flush with each other.

3 Claims, 13 Drawing Sheets

U.S. PATENT DOCUMENTS

| | | | | | |
|---|---|---|---|---|---|
| 4,224,704 | A | | 9/1980 | Nowell | |
| 4,225,265 | A | | 9/1980 | Hooker et al. | |
| 4,263,683 | A | | 4/1981 | Knoke | |
| 4,276,665 | A | | 7/1981 | Mis | |
| 4,295,234 | A | | 10/1981 | Whitehead | |
| 4,413,397 | A | * | 11/1983 | McKann | 29/416 |
| 4,444,323 | A | | 4/1984 | Travis | |
| 4,536,904 | A | | 8/1985 | Whitehead | |
| 4,554,692 | A | | 11/1985 | Whitehead | |
| 4,862,612 | A | * | 9/1989 | Sugihara et al. | 40/782 |
| 4,870,711 | A | | 10/1989 | Felix | |
| 4,901,383 | A | * | 2/1990 | Yang et al. | 5/201 |
| 5,012,538 | A | * | 5/1991 | Timm | 5/200.1 |
| 5,161,268 | A | | 11/1992 | Harrow | |
| 5,920,930 | A | | 7/1999 | Harrow | |
| 6,415,465 | B1 | | 7/2002 | Harrow | |
| 6,810,540 | B2 | | 11/2004 | Harrow | |
| 6,865,758 | B2 | | 3/2005 | Harrow | |
| 6,925,666 | B2 | | 8/2005 | Harrow | |
| 7,155,762 | B2 | | 1/2007 | Harrow | |
| 7,865,981 | B2 | * | 1/2011 | Harrow | 5/400 |
| 2004/0199997 | A1 | * | 10/2004 | Harrow | 5/201 |

OTHER PUBLICATIONS

U.S. Appl. No. 12/189,699, filed Aug. 11, 2008, Harrow.
U.S. Appl. No. 11/725,165, filed Mar. 16, 2007, Harrow.
U.S. Appl. No. 11/725,164, filed Mar. 16, 2007, Harrow.

* cited by examiner

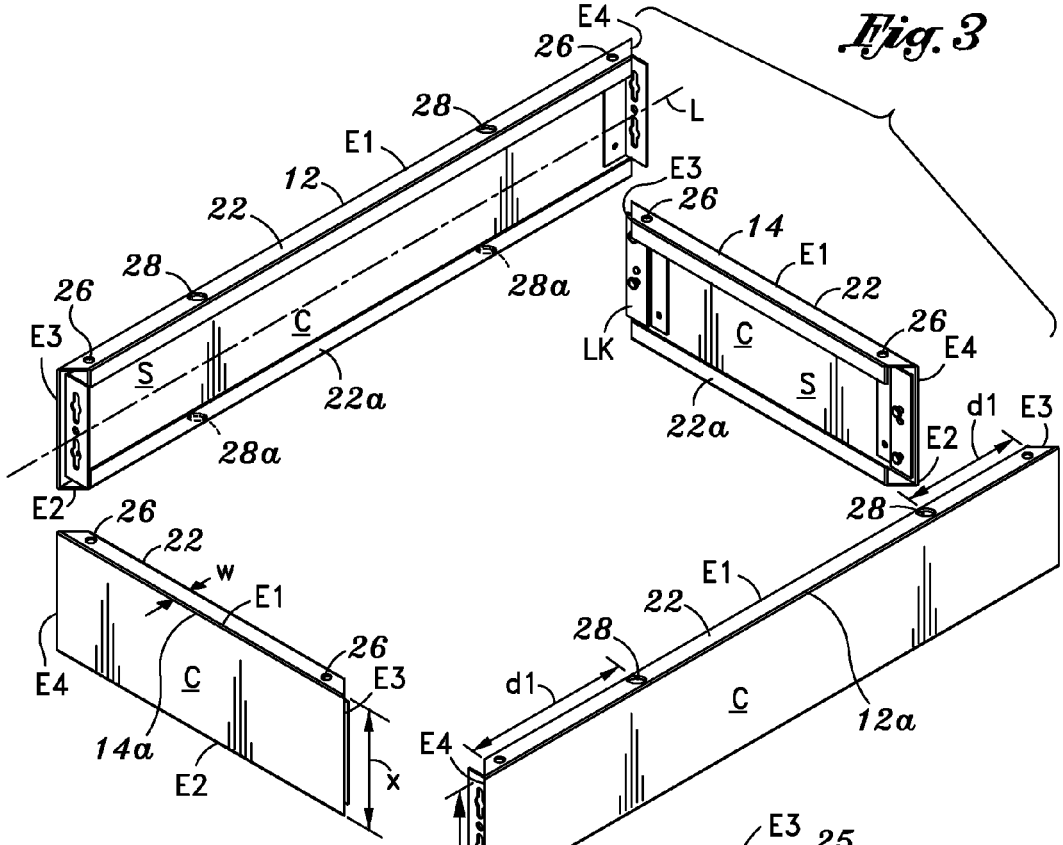
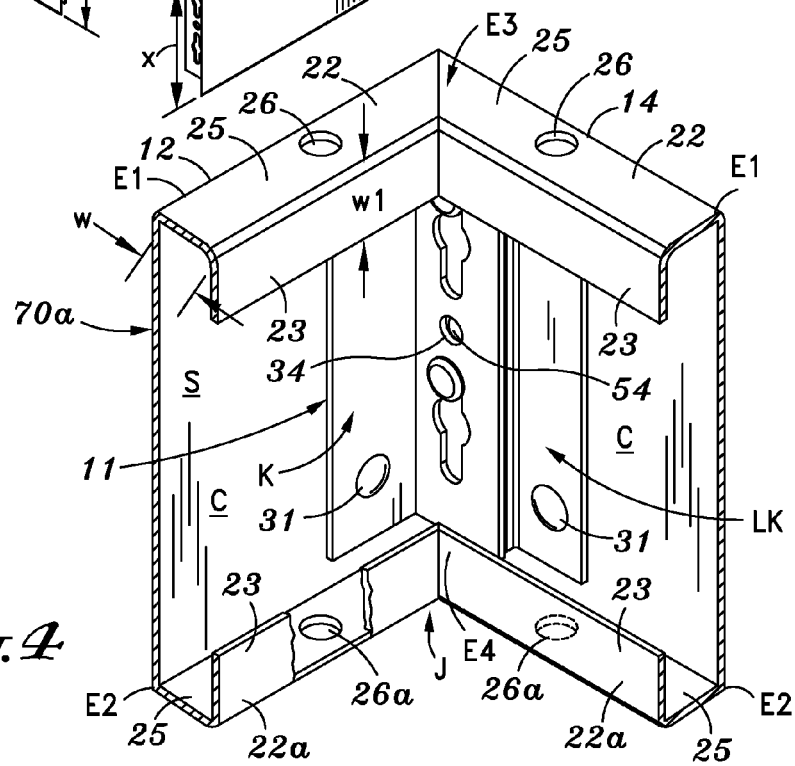
Fig. 4

EASY TO ASSEMBLE BED BASE, TWO-COMPONENT CONNECTOR AND KIT

RELATED PATENT APPLICATIONS & INCORPORATION BY REFERENCE

This application is a continuation of U.S. Ser. No. 11/326,817, filed Jan. 6, 2006, entitled "Easy To Assemble Bed Base, Two-Component Connector & Kit," now abandoned, which is a continuation-in-part of U.S. Ser. No. 11/197,759, entitled "Easy To Assemble Bed Base, Two-Component Connector and Kit," filed Aug. 4, 2005, now abandoned, which is a continuation application of U.S. Ser. No. 10/279,280, entitled "Easy To Assemble Bed Base, Two-Component Connector and Kit," filed Oct. 24, 2002, now U.S. Pat. No. 6,925,666 B2, which claims the benefit under 35 USC 119(e) of U.S. provisional patent application Ser. No. 60/337,414, entitled "Easy To Assemble Bed Base, Two-Component Connector & Kit," filed Nov. 5, 2001. All these related applications are incorporated herein by reference and made a part of this application. Moreover, the inventor incorporates herein by reference any and all U.S. patents, U.S. patent applications, and other documents, hard copy or electronic, cited or referred to in this application.

BACKGROUND OF INVENTION

Bed bases are commonly used structures to support above a floor a box-spring and mattress. Typically, they are made up of a number of pieces that are shipped unassembled and then assembled by an installer at the location where the bed base is to be used. In many prior art bed bases the pieces are frequently numerous and sometimes require the use of tools to connect them together. This adds cost to manufacturing, shipping and installing of the bed base. Ideally, a bed base should have a minimum number of pieces, be easy to package and ship, and be conveniently and quickly assembled.

SUMMARY OF INVENTION

This invention, with its several desirable features, is summarized in the CLAIMS that follow. After reading the following section entitled "DETAILED DESCRIPTION," one will understand how the features of this invention provide its benefits. The benefits of this invention include, but are not limited to: (1) low cost manufacture due to minimizing the number of pieces comprising the bed base, (2) convenience of use and assembly, (3) ease in packaging of the pieces of the bed base into a kit and ease in handling and shipping this kit, and most importantly, (4) the speed at which the pieces may be assembled into the bed base.

The bed base of this invention includes side members, each having opposed edges and opposed ends and each being symmetrical about its individual longitudinal axis. The side members are of equal width and they are positioned to stand vertically upright on one edge. The side members are preferably made from sheet metal that may be bent into a substantially C-shape cross-sectional configuration to form longitudinal, planar support members along the opposed edges of each side member. These support members assist in orienting the side members vertically. The support members are on opposite sides of a central, longitudinal, planar portion of each side member. Preferably, each support member extends outward in the same direction from the planar portion and each support member has substantially the same width and length. One support member is along one of the planar portion edges at substantially a right angle to the planar portion and the other support member is along the other of the planar portion edges at substantially a right angle to the planar portion.

At each opposed end of each side member is one component of a two-component connector. The two-component connector includes a keyhole component and a locking component. Upon assembly of the side members to form the bed base, the locking component on one side member is received in the keyhole component of an adjacent and adjoining side member. Upon connection, the respective edges of the side members are brought into a position relative to each other where their respective edges are substantially flush with each other.

The keyhole component has (a) a first opening with an enlarged central portion and a pair of narrow portions extending outward in opposite directions from the central portion, and (b) a second opening with an enlarged central portion and a pair of narrow portions extending outward in opposite directions from the central portion. The first and second openings are spaced apart a predetermined distance and each openings is equidistant from a central longitudinal axis of the side member to which the keyhole component is attached.

The locking component has first and second outwardly extending finger elements that each have an enlarged head on a narrow neck, the head being sized to pass through a central portion of an opening in a keyhole component but larger than the narrow portions of the opening and the narrow neck being sized to be received in one of the narrow portions. The first and second finger elements are spaced apart a distant equal to the predetermined distance that the openings are spaced apart and offset with respect to a central longitudinal axis of the side member to which the locking component is attached a distance sufficient to bring the opposed edges of a pair of side members together so that the edges of the side members being connected are substantially flush upon assembly of the side members.

One component of the two-component connector may include a catch element and the other component may include a receptacle. Upon manually engaging the two-component s of the two-component connector, one component moves laterally over a face portion of the other component to attain an interlocking relationship between the catch element and the receptacle, with the catch element seated in the receptacle. Preferably, at least one of the components is made of a malleable material and the catch element is formed in the malleable material. This catch element extends outward from a face portion and is positioned at a predetermined location along the one component to be received in the receptacle of the other component to attain the interlocking relationship.

With a bed base having a substantially rectangular structure, four side members are employed. Optionally, the opposed ends of the side members, in particular the support members, are at an angle of substantially 45° so that the ends of adjacent and adjoining side members form a miter joint. The connectors at each miter joint holds together the adjoining side members forming the miter joint. The side members of one pair each have first lengths that are equal to each other and the side members of another pair each have second lengths that are equal to each other and longer than the first lengths. All the side members are of equal width. The side members of the same length are opposed to each other. Each side member of one pair having the same length has a keyhole component at both opposed ends thereof. Each side member of the other pair having the same length has a locking component at both opposed ends thereof. The side members are assembled into the rectangular structure with the side members of the one pair being opposed to each other and the side members of the other pair being opposed to each other. This rectangular structure has corners formed by adjoining and adjacent opposed ends of the pairs of side members. These adjoining and adjacent opposed ends are connected together by interlocking the keyhole and locking components of each two-component connector at the corners. The opposed side members of at least one pair of opposed side members are substantially symmetrical and the keyhole component is substantially symmetrical.

Optionally, there is a brace element at each corner of at least one pair of diagonally opposed corners. Preferably, each brace element overlaps adjacent, longitudinal support members of the adjoining, adjacent ends of the side members forming the diagonally opposed corners. The brace elements may include a pair of pin members, one pin member received in a hole in one adjacent, longitudinal support member and the other pin member received in a hole in the other adjacent, longitudinal support member.

In one embodiment of this invention, a unique corner connector is employed. This unique corner connector comprises a body member including a substantially right angle shaped channel providing a retainer for a corner of the bed base. A pair of spaced apart substantially orthogonally oriented, resilient sides form outer portions of the channel. These sides are disconnected from each other to enable each side independently to flex upon connecting the corner connector to the bed base. At least one of the sides includes one component of a two-component catch member adapted to connect to the other component of the two-component catch member upon connecting the corner connector to the bed base. The corner connector may be made from a single metallic sheet using conventional metal bending and stamping techniques.

It may be desirable for the bed base to include a box-spring/mattress support bar that extends between a pair of opposed side members. Preferably, the support bar has opposed ends with a pin member at or near each end. One pin member is received in a hole in one opposed member of the pair of opposed support members and the other pin member is received in a hole in the other opposed side member of said pair. These holes in the pair of opposed support members are aligned so that the support bar is at a right angle to the support members. Preferably, the support bar has opposed ends and a bracket is mounted to each end of the support bar to move laterally between an extended position and a retracted position. Optionally, each bracket may have a catch element that holds the bracket in the retracted position.

This invention also includes the unique two-component connector used to attach the side members together and a kit wherein the various unassembled pieces of the bed base are placed in a package. The two-component connector includes the keyhole component and a pair of spaced apart locking components attached to an adjoining side member to form a corner of the bed base upon connecting together the keyhole component and the locking components. In one embodiment the pair of locking components are attached to a plate that is fixedly attached to an adjoining side member. In another embodiment, each individual locking component comprises a rivet element that is connected directly to the adjoining side member without any connecting plate. Each rivet element has an elongated shaft member with a first enlarged end that abuts an exterior surface of the adjoining side member and a second enlarged end spaced from an interior surface of the adjoining side member and interlocks with the keyhole component upon assembly.

BRIEF DESCRIPTION OF THE DRAWING

The preferred embodiments of this invention, illustrating all its features, will now be discussed in detail. These embodiments depict the novel and non-obvious bed base, connector, and bed base kit of this invention as shown in the accompanying drawings, which are for illustrative purposes only. These drawings include the following figures (Figs.), with like numerals indicating like parts:

FIG. 3 is an exploded view of the bed base side members standing vertically upright on one edge with opposed side members facing each other and positioned to be connected at adjoining, adjacent ends by two-component connectors.

FIG. 4 is an enlarged, fragmentary perspective view, with sections broken away, taken along line 4 of FIG. 2 showing one set of adjoining, adjacent side members connected by one of the two-component connectors shown in FIG. 3.

DETAILED DESCRIPTION

Embodiments of FIGS. 1 Through 12

Figure 8:
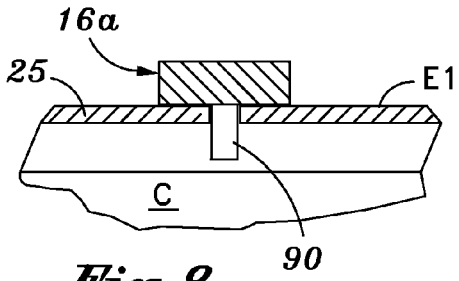
FIG. 8 is a cross-sectional view taken along line 8-8 of FIG. 1.
Figure 9:
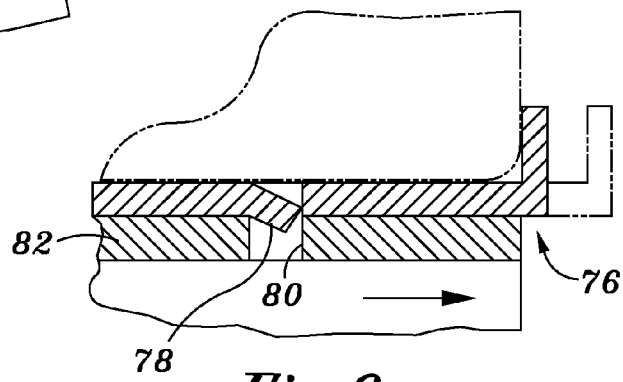
FIG. 9 is a cross-sectional view of a locking device for the brackets at the opposed ends of the box-spring support rails shown in FIG. 1.
Figure 10:
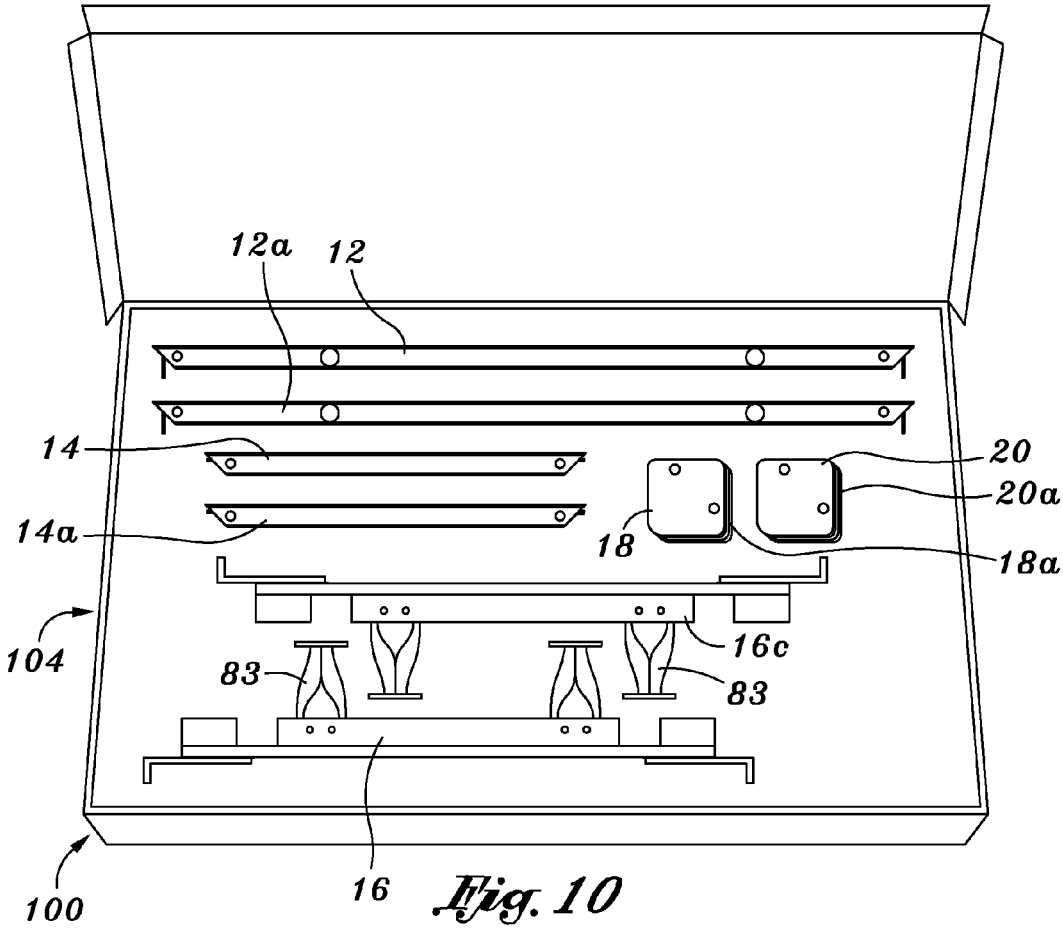
FIG. 10 is a perspective view showing the bed base kit of this invention.

This invention includes both a bed base 10 as illustrated in FIGS. 1 through 9 and a bed base kit 100 as illustrated in FIG. 10. For example, the bed base kit 100 includes all the necessary pieces to assemble, the bed base 10 depicted in FIGS. 1-9. The bed base 10 is sized to support a standard double box spring 102 (shown in phantom lines). Kits for twin, queen, king and even custom size box springs and mattresses are also within the scope of this invention. As discussed subsequently in greater detail, the number of pieces in the kits of this invention will vary depending on the size of the box springs and mattresses being supported by the bed base.

The bed base 10 includes (a) four generally rectangular side members 12, 12*a*, 14, 14*a*, (b) a pair of box-spring/mattress support bars 16, 16*a* extending between, and at right angles to, the pair of keyhole component K1 opposed side members 12, 12*a*, and (c) four corner brace plates 18, 18*a* and 20, 20*a*. The members 12, 12*a*, 14, and 14*a* are first assembled into a rectangular structure 9 (FIG. 2) with adjoining, adjacent ends E3 and E4 of the side members 12, 12*a*, 14, and 14*a* positioned at right angles to each other to form the rectangular structure's corners 70*a* through 70*b*. A two-component connector 11 shown in detail in FIGS. 5, 6, and 7A and 7B securely connects the adjoining adjacent ends E3 and E4 at each corner 70*a* through 70*b*.

The individual side members 12, 12*a*, 14, and 14*a* are preferably made from roll formed sheet steel having a thickness of from about 16 to about 20 gauge. The sheet steel is bent into the desired configuration using conventional manufacturing equipment. The opposed side members 12, 12*a* are of the same length of about 71 inches and they do not vary no matter what the size of the box-spring and mattress being supported. Depending on the size of the box-spring and mattress being supported, the opposed side members 14, 14*a* have a length ranging from about 26 to about 63 inches. For any type of box-spring and mattress being supported, the opposed side members 14, 14*a* are of the same length. For example, when a twin size box-spring and mattress is being supported, the length is 26 inches, when a full size box-spring and mattress is being supported, the length is 40 inches, when a king size box-spring and mattress is being supported, the length is 58⅞ inches. All the side members 12, 12*a*, 14, 14*a* are of the same width x ranging from about 5 to about 18 inches. Each individual side member 12, 12*a*, 14, 14*a* is symmetrical about its central longitudinal axis L.

As best shown on FIGS. 3 and 4, each individual side member 12, 12*a*, 14, and 14*a* has a generally C-shaped cross-sectional configuration comprising a central, longitudinally extending, planar portion C with opposed edges E1 and E2. The opposed ends E3 and E4 of each individual side member 12, 12*a*, 14, and 14*a* are cut inward at an angle of substantially 45° to enable the adjoining, adjacent ends E3 and E4 of adjoining, adjacent side members to form a miter joint at each corner 70*a* through 70*b*. Such a miter joint J is depicted in FIG. 4 showing the adjoining, adjacent side members 12 and 14 with their respective adjoining, adjacent ends E3 and E4 abutting each other.

There extends outward in the same direction, respectively from each edge E1 and E2, an L-shaped shoulder support/stiffener 22 and 22*a*. The support/stiffeners 22 and 22*a* face each other, with their feet 23 pointing at each other and their legs 25 oriented horizontally to form longitudinal, planar support platforms. Each longitudinal support platform, or leg 25, has substantially the same width w, typically from about ¾ to about 1¼ inches. The length of each individual leg 25 is the same as the length of the side member from which it extends. Each leg 25 is at a right angle to the planar portion C. The individual feet 23 extend from an outer tip of the leg 25 from which it extends and each has the same width w1, typically from about ¾ to about 1¼ inches. The length of the individual feet is the same as the length of the leg from which it extends. Preferably, for any bed base the width w and w1 are equal, typically each being I inch.

In the individual side members 12, 12*a*, 14 and 14*a* there are two pairs of these holes 26, 26*a* near opposed end E3 and E4. The individual holes 26 are in the legs 25 that extend from the edge E1 and the individual holes 26*a* are in the legs 25 that extend from the edge E2. The individual holes 26 and 26*a* in each pair of holes are in alignment with each other. In the individual side members 12, 12*a* there are two additional pairs of holes, referred to as intermediate holes 28, 28*a*, spaced apart a distance d, which varies depending on the size of the box-spring and mattress being supported. Each individual pair of intermediate holes 28, 28*a* is set back from its closest end E3 or E4, as the case may be, by an equal distance d1, typically from about 6-12 inches. The individual holes 28 are in the legs 25 that extend from the edge E1 and the individual holes 28*a* are in the legs 25 that extend from the edge E2. The individual holes 28 and 28*a* in each pair of holes are in alignment with each other.

Because the side members 12, 12*a*, 14 and 14*a* are so designed as discussed above, the two halves of each individual side member partitioned along its longitudinal axis L are mirror images, making each side member symmetrical about its longitudinal axis. Each individual side member 12, 12*a*, 14 and 14*a* is also symmetrical about a central axis ZZ passing through the center of each side member and at a right angle to the individual member's longitudinal axis L. This feature of structural symmetry of the side members 12, 12*a*, 14 and 14*a* is important for quick and easy assembly of the bed base of this invention, as will be better understood upon reading the section entitled "Bed Base Assembly."

Figure 5:
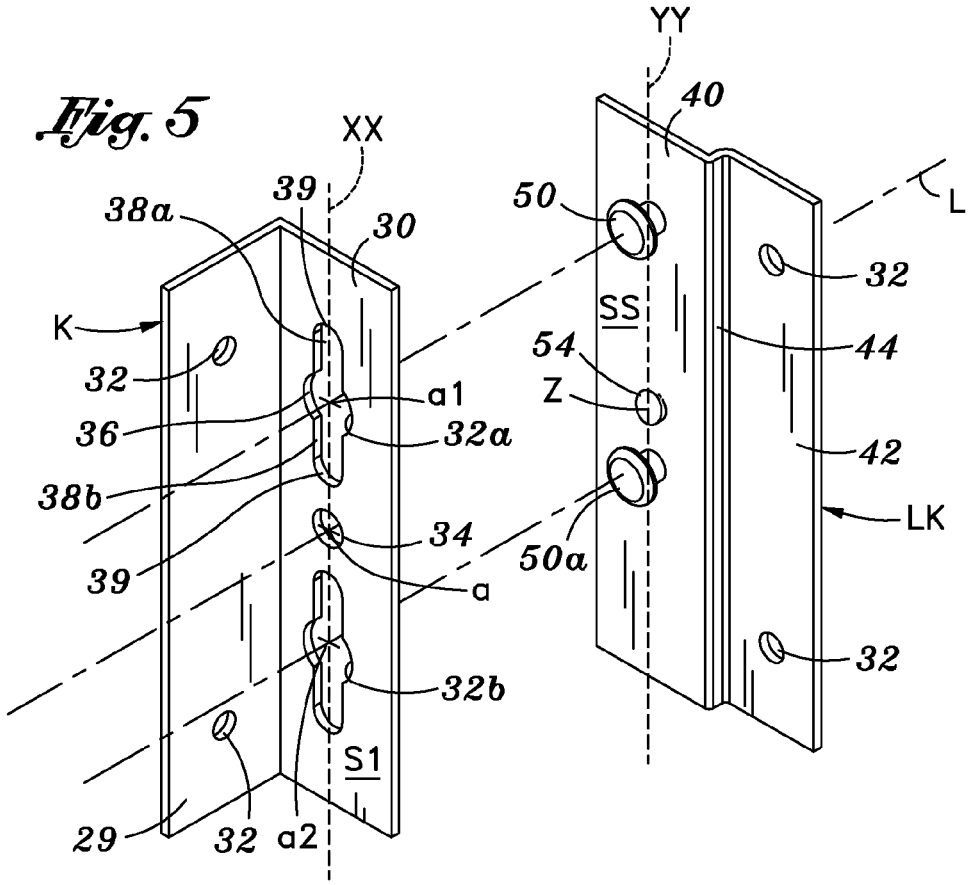
FIG. 5 is a perspective view of each component of the two-component connector shown in FIG. 4 prior to being attached to a side member and prior to being connected to each other.
Figure 6:
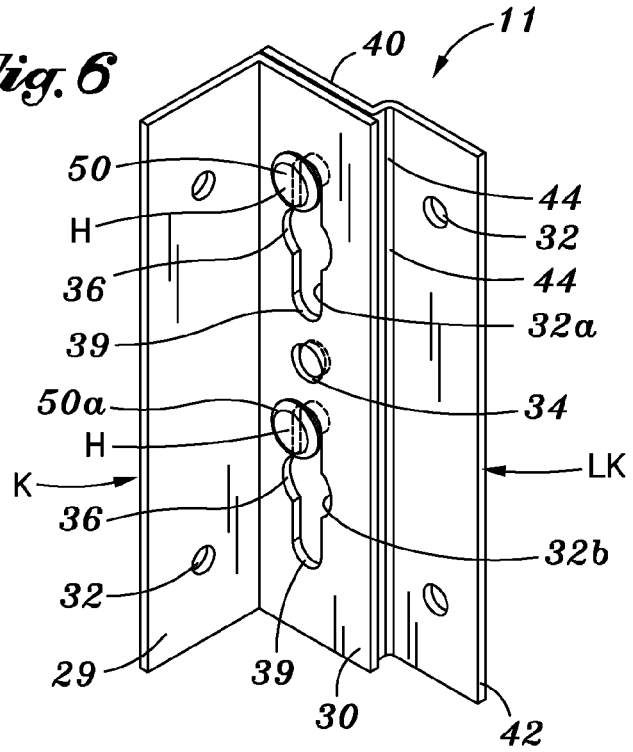
FIG. 6 is a perspective view showing the components of the two-component connector shown in FIG. 4 connected to each other.

As best shown in FIGS. 5 and 6, the two-component connector 11 with each component made from steel sheet. The two-component connector 11 includes (a) a keyhole component K, one attached, respectively, to each of the opposed ends E3 and E4 of the members 12 and 12*a*, and (b) a locking component LK, one attached, respectively, to each of the opposed ends E3 and E4 of the members 14 and 14*a*. These components K and LK are fastened securely by rivets 31 to the planar portions C of the side members 12, 12*a*, 14, and 14*a*. The rivets 31 pass through holes 32 in these components K and LK. These components K and LK are all attached to the inside surfaces S of the planar portions C of the side members 12, 12*a*, 14, and 14*a*, so that they all face inwardly upon assembly of these side members to form the bed base 10.

The keyhole component K has a generally L-shape configuration and in one leg 29 are the holes 32 for the rivets 31 and in another leg 30 are two identically, symmetrically shaped oblong-type openings 32*a* and 32*b* aligned along an axis XX of this leg 30. There is a centrally located hole 34 with its center coincident with the center a of the leg 30 and the longitudinal axis L intersecting this center a at a right angle to the leg 30. This hole 34 serves as a receptacle for a catch element 54 on the locking component LK. The centers a1 and a2 respectively of the openings 32*a* and 32*b* are equidistant from the longitudinal axis L of the side members to which each keyhole component K is attached. Each opening 32*a* and 32*b* has an enlarged central, circular portion 36 and a pair of narrow rectangular portions 38*a* and 38*b*, each with rounded outer terminal ends 39. These narrow portions 38*a* and 38*b* extend outward in opposite directions from the central portion 36 at equal distances from the center of the circular portion 36, centers a1 or a1 as the case may be. They lie along a common line which is substantially at a right angle to the longitudinal axis L. Thus, each opening 32*a* and 32*b* is symmetrical about its respective center a1 or a1 as the case may be, and these openings 32*a* and 32*b*, being positioned equidistant from the longitudinal axis L and aligned along the axis XX, make the leg 30 symmetrical.

The locking component LK has two plates 40 and 42 connected by a narrow section 44. The holes 32 for the rivets 31 are in the plate 42 and a pair of fingers 50 and 50*a* extend outwardly from the inside surface SS of the plate 40. The locking component LK, preferably being made of a malleable material such as steel sheet, has the catch element 54 formed in this malleable material by partially punching the steel sheet. The catch element 54 extends outward from the inside surface SS of the plate 40. Each finger 50 and 50*a* has an enlarged head H mounted on an end of a narrow neck N. The neck N is sufficiently long to facilitate interconnecting the keyhole component K and the locking component LK by allowing the neck N to slide along the either portion 38*a* or 38*b* while the head rides on the surface S1 of the leg 30 of the keyhole component K. Each head H is sized to pass through the central portion 36 of the symmetrically shaped openings 32*a* and 32*b* in the keyhole component K but are larger than the narrow portions 38*a* and 38*b*. The narrow neck N is sized to be received in the one of narrow portion 38*a* or 38*b* upon assembly of the bed base 10.

The fingers 50 and 50*a* are aligned along the longitudinal axis YY of the plate 40 and the catch element 54 is along this axis YY between the fingers, closest to the finger 50*a*. The longitudinal axis YY is substantially at a right angle to the longitudinal axis L. The catch element 54 is positioned at a predetermined location along the axis YY to be received in the hole 34 of the keyhole component K to attain an interlocking relationship upon connecting the two-component s K and LK of the two-component connector 11. Each locking component LK is attached to the central portion C of a side member 14 or 14*a*, as the case may be, so that the center Z of the catch element 54 is along the central longitudinal axis L of the side member to which it is attached. This positions the center of the head H of the finger 50 a distant of d3 from the edge E1 and the center of the head H of the finger 50*a* a distant of d4 from the edge E2. The distance d4 is greater than the distance d3. The distant between the centers of the heads H of the fingers 50 and 50*a* is equal to the distant d5 between the centers a1 and a2 of the symmetrically shaped openings 32*a* and 32*b* in the keyhole component K.

Figure 7A:
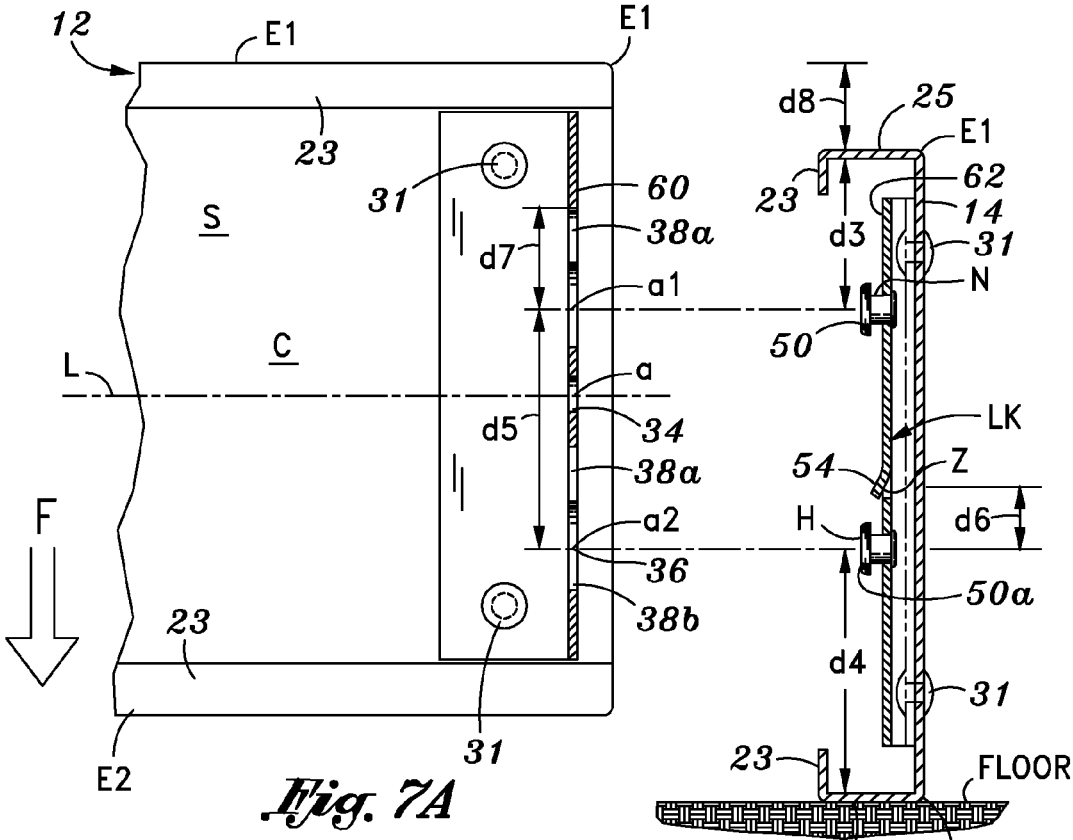
FIG. 7A is a partial cross-sectional view showing adjacent side members positioned apart from each other and aligned so that the individual components of the two-component connector at adjacent ends of these side members are aligned for connection with each other.

It is important that each locking component LK of each pair of locking components mounted to a side member 14 and 14*a* be positioned correctly on the side member to which it is attached to properly interconnect with its counterpart keyhole component. As shown in FIG. 7A, the position of each pair of components LK is such that, when the heads H of the fingers 50 and 50*a* are aligned, respectively, with the centers a1 and a2 of the openings 38*a* and 38*b* in the keyhole component K, the top edge E1 of the side member 14 is below the top edge E1 of the side member 12 a distance d8. This distance d8 is equal to the distance d7 between each center a1 and a2 and each of the rounded ends 39 of the portions 38*a* and 38*b* of the openings 32*a* and 32*b*. The distance d6 between the head H of the finger 50*a* and the center Z of the catch element 54 is equal to the distance d7 and the distance d8. Consequently, the installer can only move the two side members 12 and 14 this distance d8 only in one direction to lock the side members together. Specifically, the installer moves the side members 12 and 14 relative to each other to bring the catch element 54 of the locking component LK into locking engagement with the hole 34 in the keyhole component K to connect securely the adjoining, adjacent side members 12 and 14. This simplifies the assembly of the bed base 10, enabling the installer to assemble more rapidly all the side members 12, 12*a*, 14, and 14*a* into the rectangular structure 9.

Figure 1:
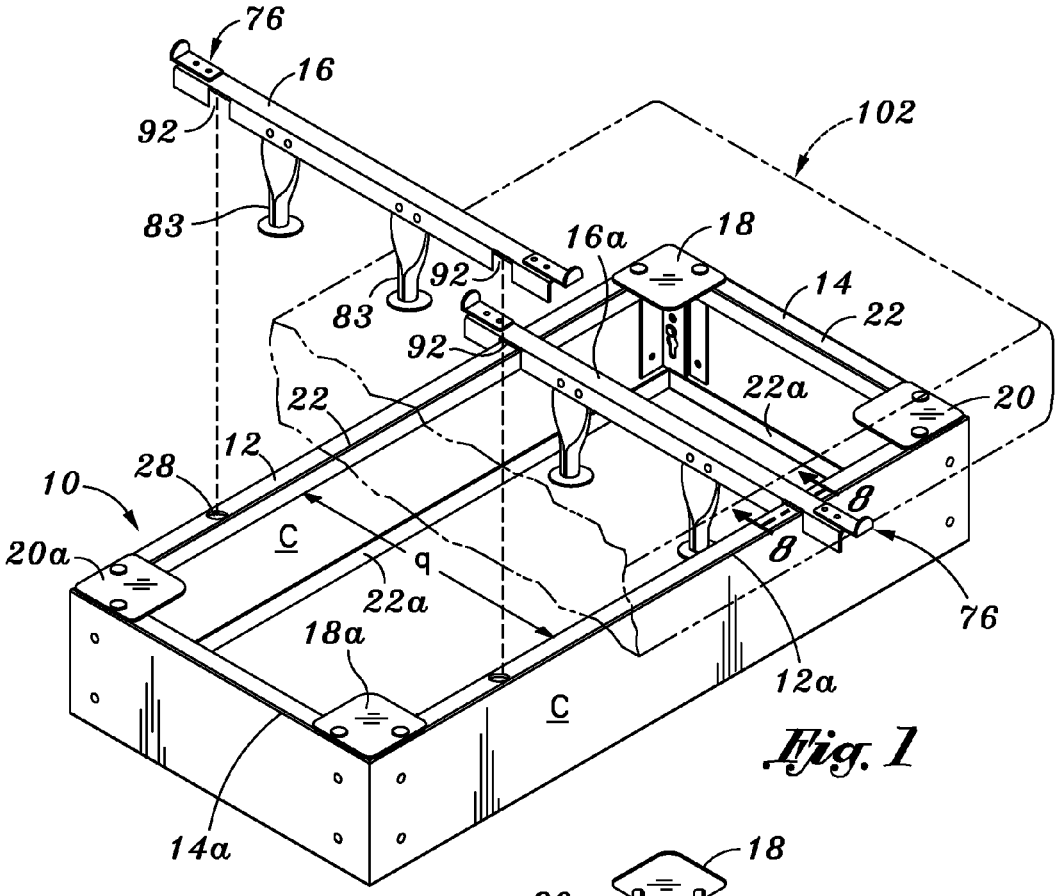
FIG. 1 is a partially exploded perspective view of the assembled bed base of this invention.
Figure 2:
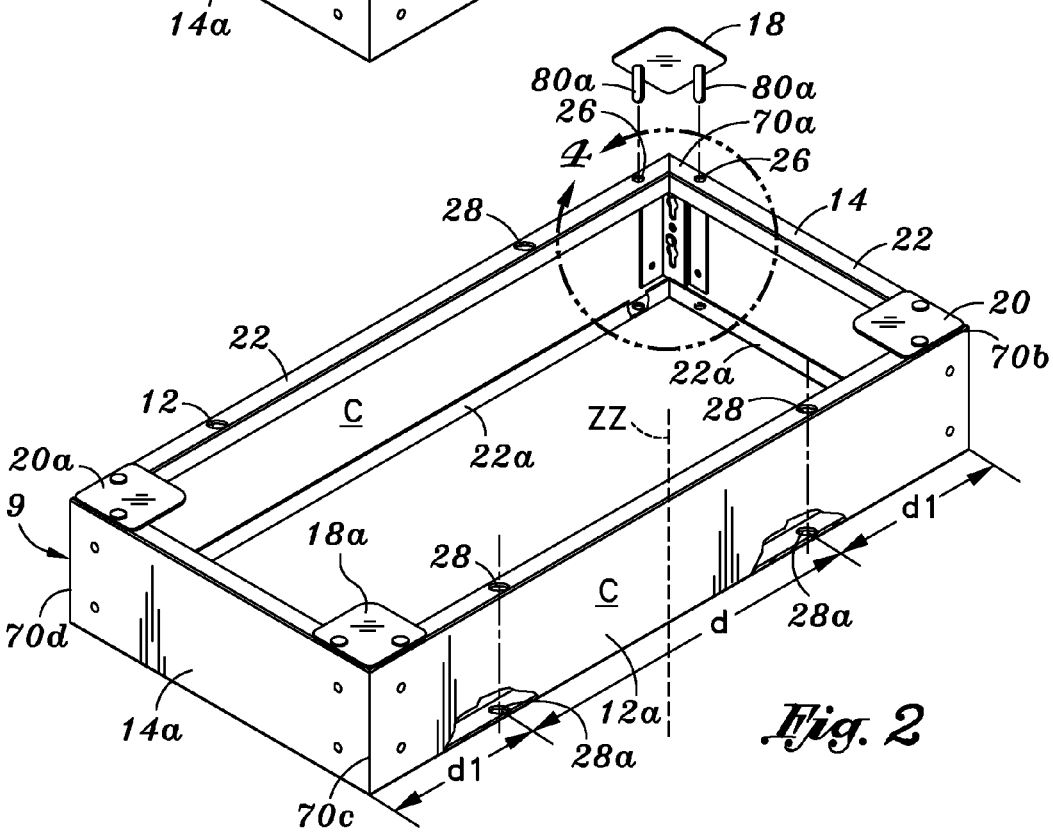
FIG. 2 is a partially assembled bed base of this invention, with sections broken away.

As best shown in FIGS. 1 and 9, each support bar 16 and 16*a* has an L-shaped arm 82 that has at each opposed ends thereof a bracket 76 mounted thereto to move laterally between an extended position shown in dotted lines in FIG. 9 and a retracted position shown in solid lines in FIG. 9. There is a catch element 78, similar to the catch element 54, that holds the bracket 76 in the retracted position by locking engagement with a hole 80 in the arm 82 to which the bracket is attached, in this case the opposed ends of the support bar 16*a*. The details of this bracket are discussed in U.S. Pat. No. 5,920,930. Inward from each opposed end of the support bars 16 and 16*a* is a cut-away section 92. The cut-away sections 92 on each support bar 16 and 16*a* are spaced apart from each other by a distance equal to the distance q between the opposed feet 23 of the side members 12 and 12*a*. Each cut-away section 92 has a width that is about equal to the width w of the legs 25. A pair of stands 83 extend at right angles downward from intermediate locations along the arm 82 between the cut-away sections 92. More than two stands 83 may be used when larger bed bases are provided in the case of queen and king sizes.

As shown in FIG. 8, near each opposed end of each support bar 16 and 16*a* is a downward projecting pin 90. Each one of these pins 90 at the opposed ends of the supports bar 16 and 16*a* is positioned between the bracket 76 at an adjacent opposed end and the adjacent cut-away section 92. As illustrated in FIG. 1, when the support bars 16 and 16*a* are placed at right angles to the side members 12 and 12*a* on top of the opposed edges E1, the cut-away sections 92 in each support bar 16 and 16*a* fit snugly over these opposed edges. As depicted in FIG. 8, the pins 90 on each support bar 16 and 16*a* are aligned to pass through the intermediate holes in the legs 25 of the opposed side member 12 and 12*a*, in this case the opposed aligned holes 28. If the side members 12 and 12*a* where inverted, the pins 90 would pass through the aligned intermediate holes 28*a*.

Bed Base Assembly

The installer assembles the four side members 12, 12*a*, 14, 14*a* by standing them vertically upright on their edges E2 and connecting together the keyhole component K and locking component LK of the two-component connectors 11 at adjoining, adjacent ends E1 and E2 of adjoining, adjacent side members. For example, to interlock the two-component s K and LK of the connector 11 at the adjoining, adjacent ends E3 and E4 of the side members 12 and 14, the installer first aligns the fingers 50 and 50*a*, respectively, with the enlarged central, circular portions 36 of the openings 32*a* and 32*b* as shown in FIG. 7A. Next, the installer moves the two-component s K and LK into engagement with each other, passing the heads H of the fingers 50 and 50*a* through the openings 32*a* and 32*b* in the keyhole components K. The fingers 50 and 50*a* pass through the openings 32*a* and 32*b* and a backside face 60 of the keyhole component K is pushed against a front side face 62 of locking component LK.

Figure 7B:
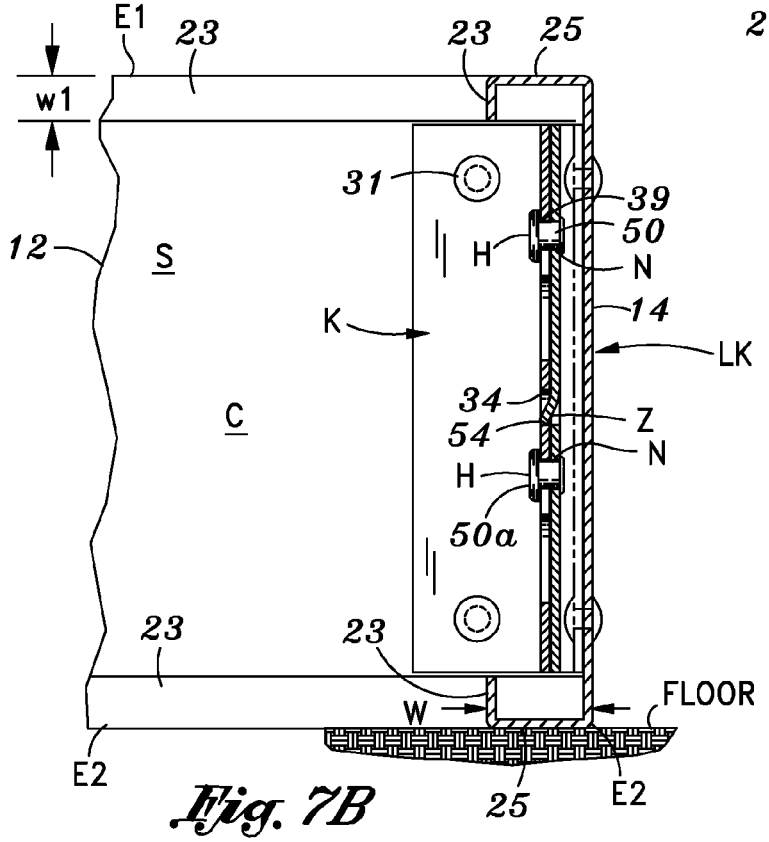
FIG. 7B is a partial cross-sectional view like that of FIG. 7A showing the individual components of the two-component connector connected to each other.

With the fingers 50 and 50*a* extending through openings 32*a* and 32*b*, the installer pushes the side member 12 downward in the direction indicated by the arrow F while the edge E2 of the side member 14 rests against a floor. This moves the locking component LK laterally over the backside face 60 of the keyhole component K to press the necks N of the fingers 50 and 50*a* respectively against the rounded outer ends 39 of the rectangular portions 38*a* and 38*b* of the opening 32*a* and 32*b*. As shown in FIG. 7B, the heads H are external to the rectangular portions 38*a* and 38*b* and the catch element 54 snaps into locking engagement with the hole 34 to lock the components K and LK together. Thus, when adjoining side members 12, 12*a*, 14, and 14*a* are assembled to form the rectangular structure, the respective edges E1 and E2 are flush with each other as shown in FIG. 7B. Because of the symmetry of the side members 12 and 12*a*, the installer never needs to be concerned whether or not these members are in inverted, because of they have identical mirror halves. The side members 14 and 14*a* are always positioned by the installer in the same manner with the finger 50*a*, the finger nearest the edge E2 closest to the floor. The installer, however, place the side members 12 and 12*a* on the floor and then attach the side members 14 and 14*a*.

Connecting the two-component connectors 11 at each corner 70*a* through 70*d* forms the rectangular structure 9. When the installer has assembled the rectangular structure 9, the brace plates 18 and 18*a* are attached at each diagonally opposed corners 70*a* and 70*c* and the brace plates 20, 20*a* are attached at diagonally opposed corners 70*b* and 70*d*. As illustrated in FIG. 1, each brace plate 18, 18*a*, 20, and 20*a* have a pair pins 80, 80*a*. The brace plate at each corner 70*a* through 70*b* overlaps and is mounted to adjoining, adjacent side members, with one pin of each pair extending through the holes 26 in the legs 25 at adjacent ends of adjoining, adjacent side members. For example, the one pin 80 is received in the hole 26 in the leg 25 of the support/stiffener 22 of the side member 12 and the other pin 80*a* on this same brace plate 18 is received in the hole 26 in the leg 25 of the support/stiffener 22 of the side member 14.

The installer places the box-spring/mattress support bars 16 and 16*a* on top of the rectangular structure 9 to extend between the opposed side member 12 and 12*a* as shown in FIG. 1. As discussed above, one pin 90 at one opposed end of a support bar is received in the hole 28 in one leg 25 of the side member 12 and the other pin 90 is received in the hole 28 in the one leg 25 of the opposed side member 12*a*. The holes in the legs 25 of the opposed side members 12 and 12*a* are aligned so that the support bars 16 and 16*a* are each at a right angle to these opposed side members.

Bed Base Kit

The bed base kit 100 includes a package 104 containing all the pieces to assemble the bed base 10: namely, the four side members 12, 12*a*, 14, and 14*a*, the four corner brace plate 18, 18*a*, 20, and 20*a*, and the two box-spring/mattress support bars 16 and 16*a*. The package may be substantially smaller that that depicted, requiring the individual pieces to be stacked on top of each other. A smaller package would be more convenient to ship. Each component K and LK of the two-component connectors 11 are attached to the side members 12, 12*a*, 14, and 14*a*, with each side member having the same type of component at each opposed end and each pair of side members having the same length employing identical components. Specifically, the side members 12 and 12*a* have the keyhole component K at each opposed end E3 and E4 and the side members 14 and 14*a* have the locking component LK at each opposed end E3 and E4.

When a twin size bed base is provided, fewer pieces are needed than the kit 100 depicted in FIG. 10. In the case of a twin size bed base, a kit includes four side members, only one pair of corner brace plates, and only one box-spring/mattress support bar. The dimensions of the side members and the box-spring/mattress support bar would be appropriate for supporting the twin size box-spring. The corner brace plates would be attached to diagonal corners.

Alternate Brace Plate

Figure 11:
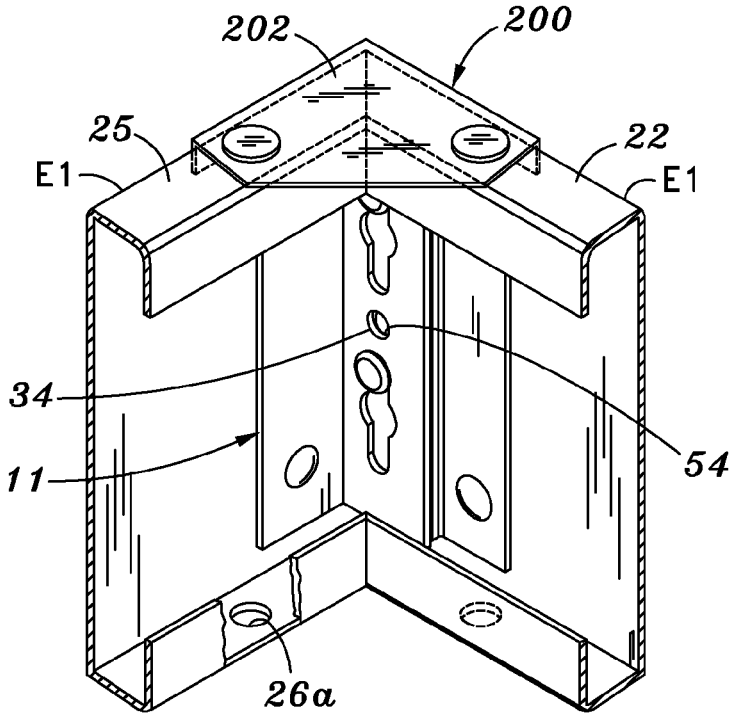
FIG. 11 is a perspective view of an alternate shaped brace plate used in this invention, showing the plate attached to a corner.
Figure 12:
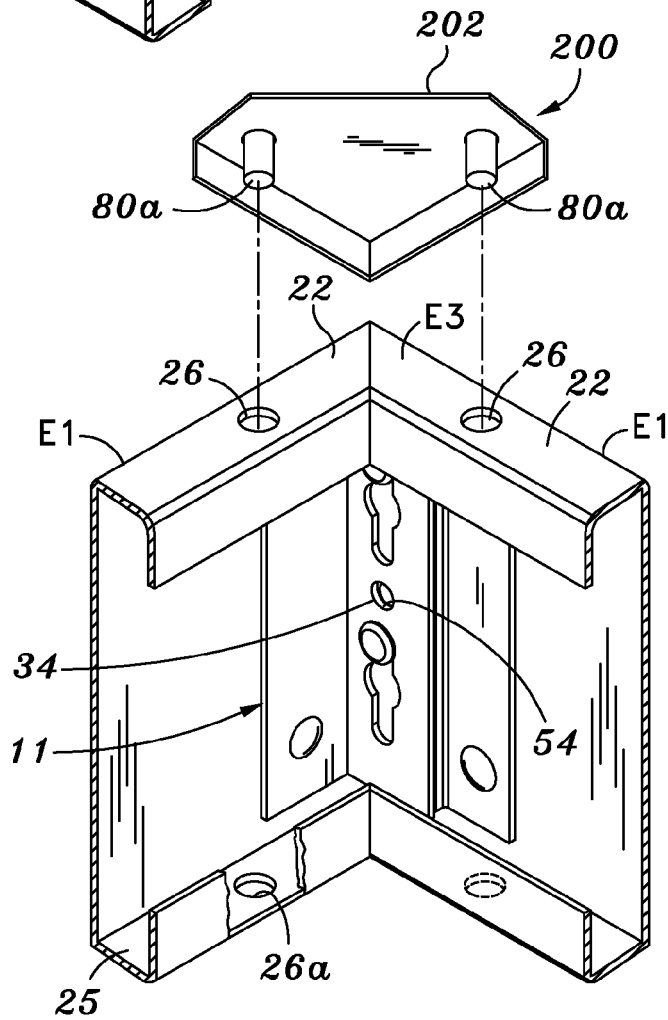
FIG. 12 is a perspective view illustrating the alternate shaped brace plate of FIG. 11 tilted to show its underside.

An alternate form of a brace plate, designated by the numeral 200, as shown FIG. 11, employs a plate 202 with a triangular shape. The pair pins 80*a* extend from the underside of the plate 202 and are positioned to be received in the holes 26 near the corners of the assembled side members as discussed above.

Embodiments of FIGS. 13 Through 20

FIGS. 13 through 20 illustrate two versions of a snap-on corner connector 300 and 400, and an alternate two-component connector 11*a*. In the bed base 10 depicted in FIG. 13, the snap-on corner connector 300 replaces the four corner brace plates 18, 18*a*, 20, and 20*a* shown in FIGS. 1, 2, 10, 11, and 12. FIGS. 18A and 18B illustrate the snap-on corner connector 400. The two-component connector 11*a* replaces the previous version of the two-component connector 11 as shown in FIGS. 4 through 7B, 11 and 12.

Snap-On Corner Connector

Figure 13:
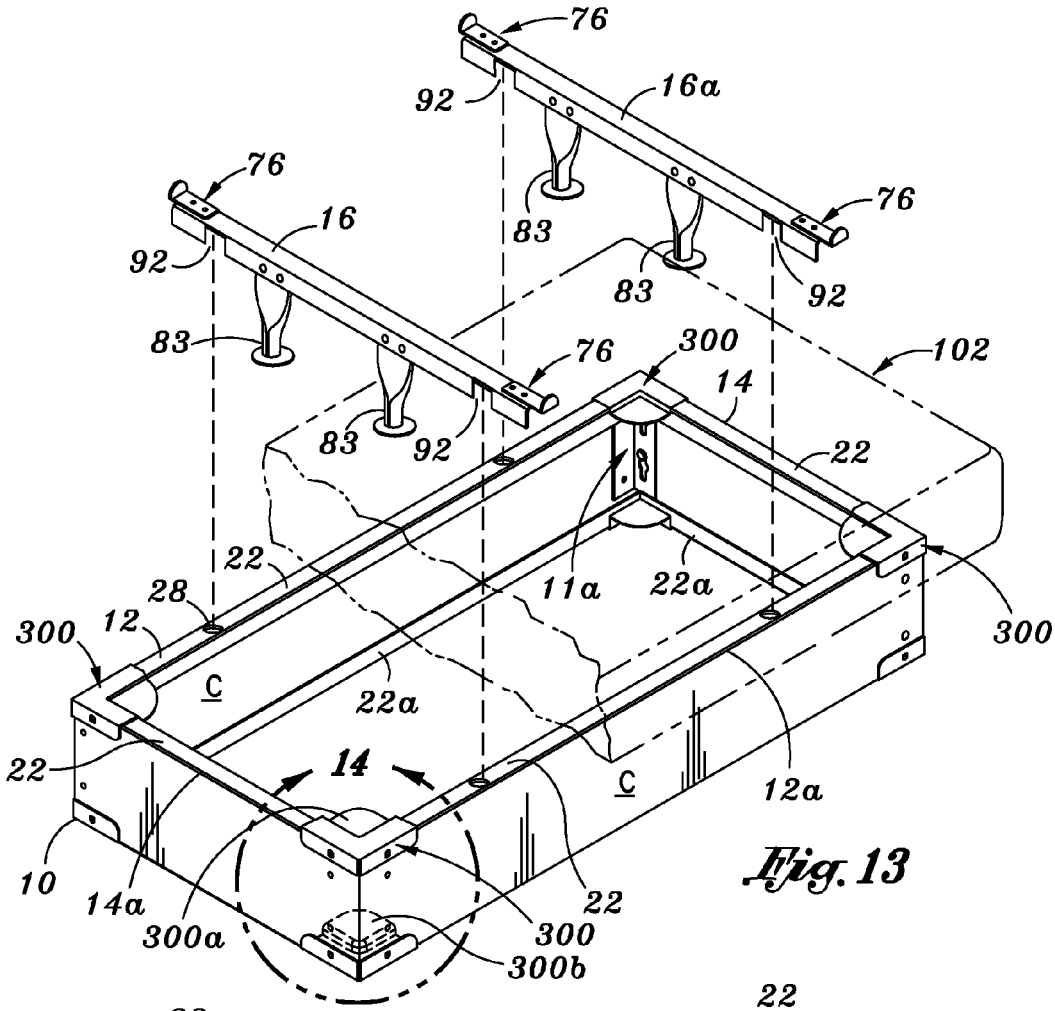
FIG. 13 is a partially exploded perspective view of an alternate embodiment of this invention employing a snap-on corner connector and another embodiment of the two-component connector.
Figure 14:
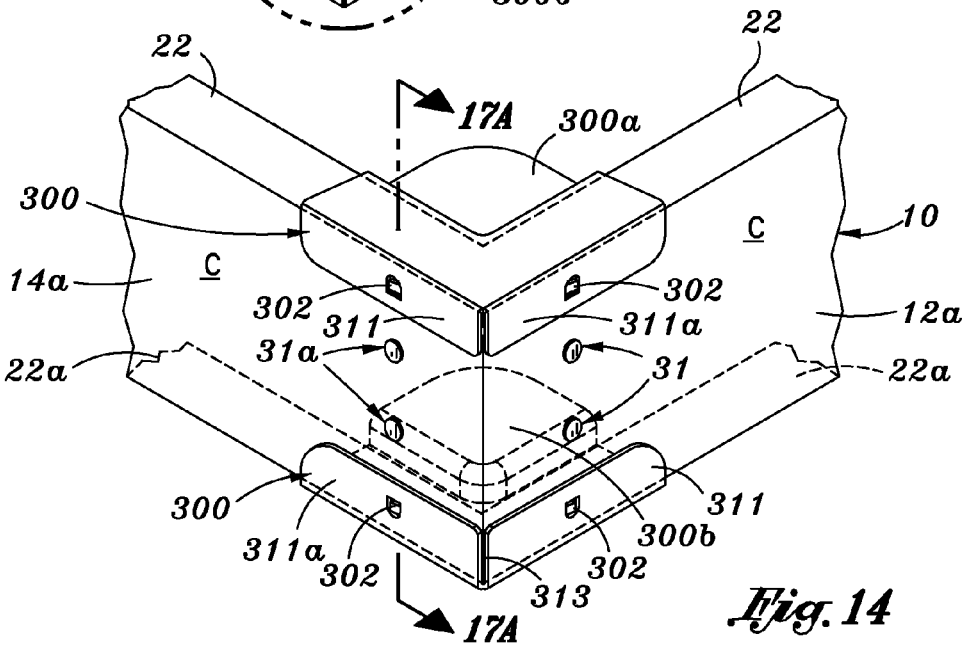
FIG. 14 is a fragmentary perspective view taken along line 14 of FIG. 13, showing a pair of snap-on corner connectors attached respectively to the top and bottom of the bed base.
Figure 14A:
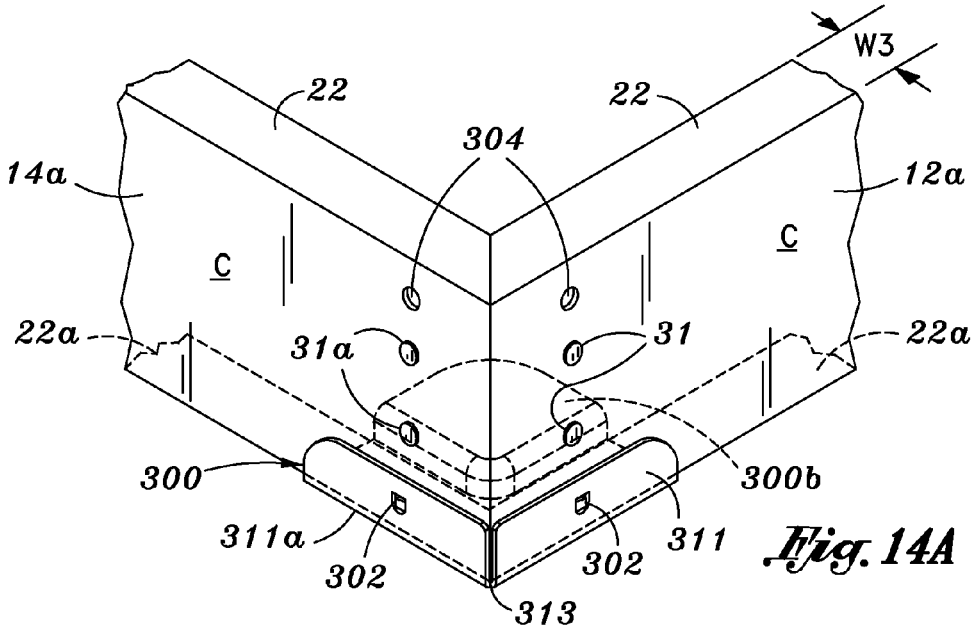
FIG. 14A is a fragmentary perspective view, showing only one snap-on corner connector attached to the bottom of the bed base.

As shown in FIGS. 13 and 14, the bed base 10 has substantially vertically oriented side members 12 and 14, 12*a* and 14*a* forming four corners of the bed base. As illustrated in FIG. 13 there is a snap-on corner connector 300 at each corner of the bed base 10 on the topside and bottom side of each corner. The snap-on corner connector 300 as a whole fits over and into any given corner of the bed base 10, on the corner's topside or the corner's bottom side or both. FIG. 14 depicts using a pair of snap-on corner connectors 300, one installed on the topside of the bed base 10 and the other on the bottom side of the bed base 10, insuring that the corner is reinforced to thereby improve the rigidity to bed base 10. FIG. 14A depicts using only one snap-on corner connector 300 installed on the bottom side of the bed base 10. The snap-on corner connector 300 is installed into any corner, either topside or bottom side or both, through direct pressure application of the hand, a rubber mallet, or other forceful means.

Figure 15:
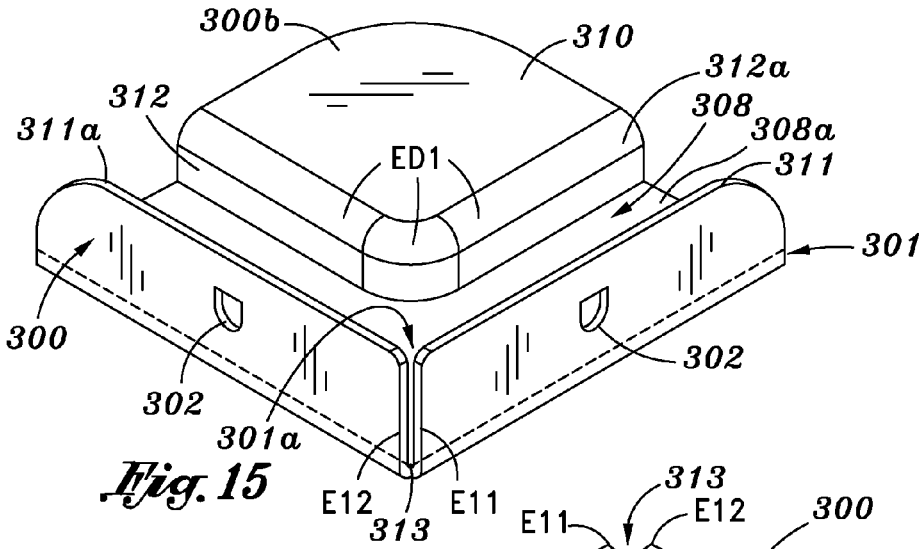
FIG. 15 is a frontal perspective view of the snap-on corner connector of this invention showing the underside of the connector.
Figure 16:
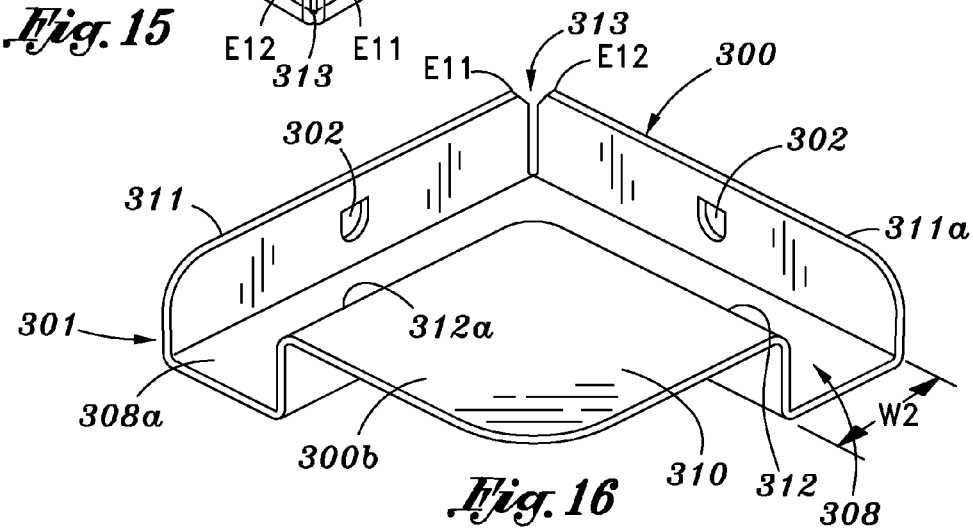
FIG. 16 is a rear perspective view of the snap-on corner connector of this invention showing the underside of the connector.
Figure 18A:
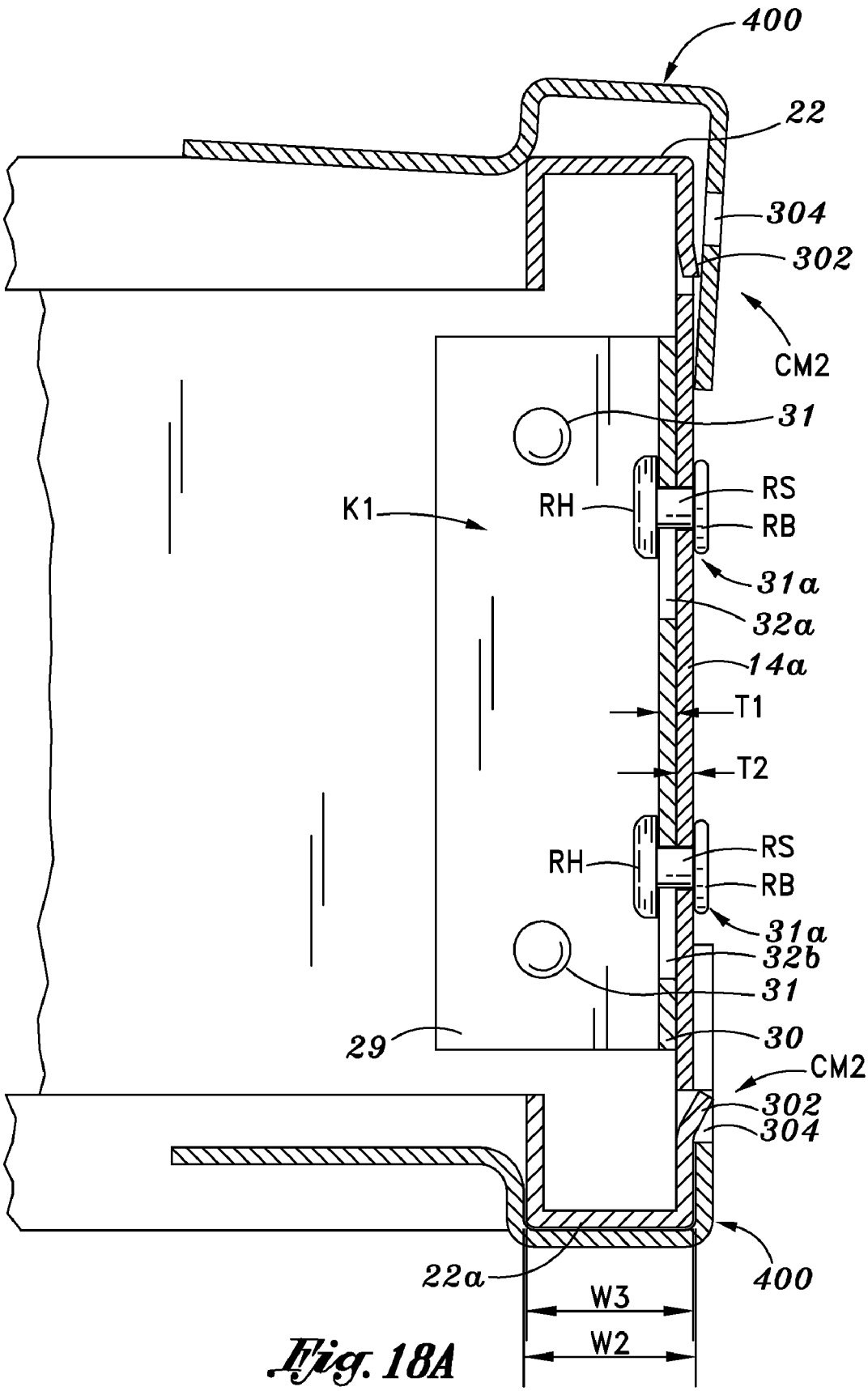
FIG. 18A is a cross-sectional view showing an alternate embodiment of the snap-on corner connector showing the bottom snap-on corner connector attached to the bed base and the top snap-on corner connector positioned to be attached to the bed base.
Figure 18B:
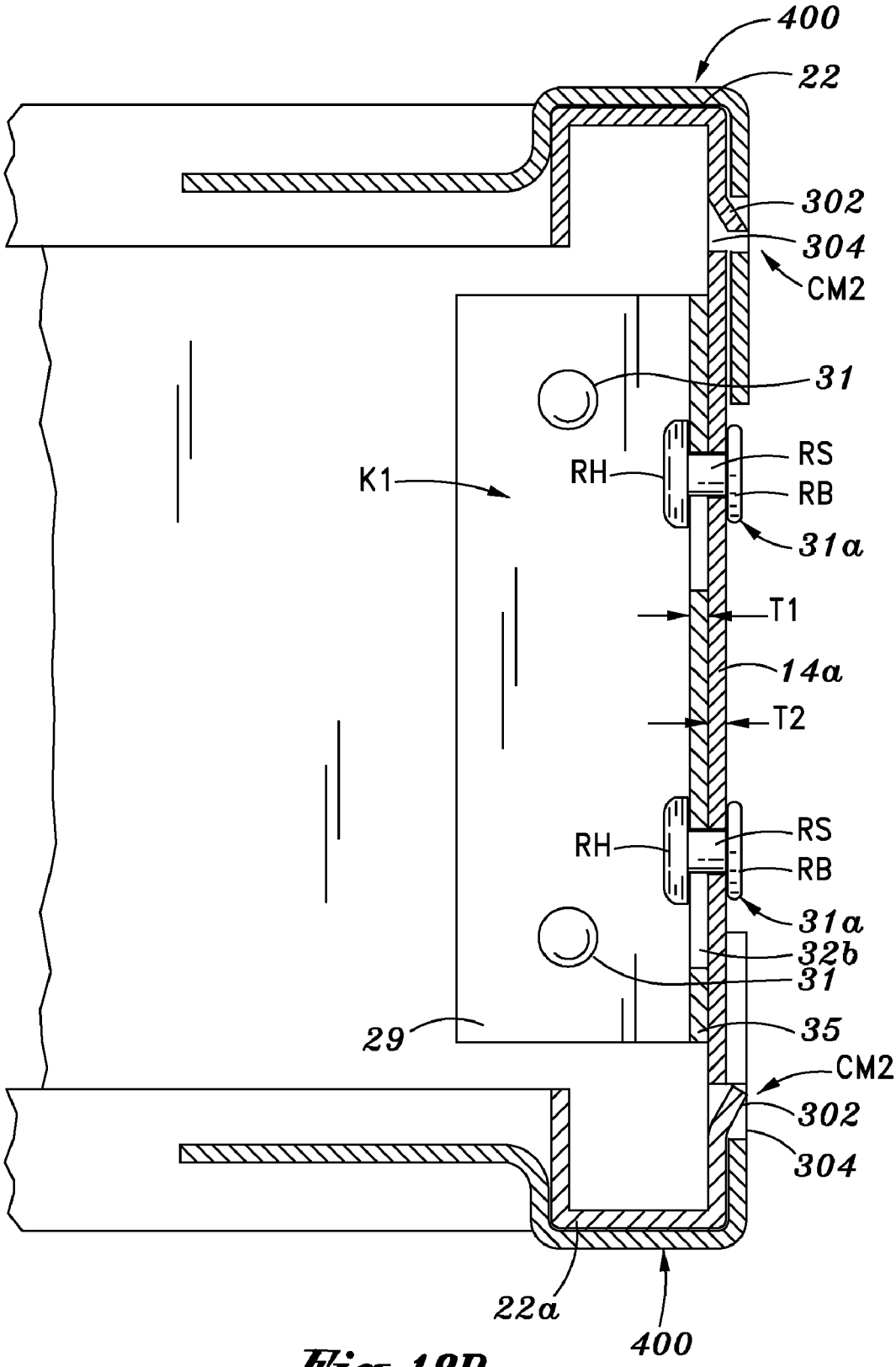
FIG. 18B is a cross-sectional view of the alternate embodiment depicted in FIG. 18A showing both the top and bottom snap-on corner connectors attached to the bed base.

As best shown in FIGS. 15 and 16, the snap-on corner connector 300 has a main body member 301 including a substantially right angle shaped channel 308. The body member 301 has an external side 300*a* (FIG. 14) and an internal side 300*b* (FIGS. 15 and 16), and an external orthogonal corner 301*a*. The channel 308 serves as a retainer for the shoulder support/stiffener 22 and or 22*a*, as the case may be, of the side members 12 and 14, 12*a* and 14*a* of the bed base 10. The channel 308 includes a floor 308*a*. Connected to the inner portion of the floor 308*a* at a substantially right angle is a first pair of substantially planar, substantially orthogonally oriented sides 312 and 312*a*. Also connected to the floor 308*a* is a pair of spaced apart substantially orthogonally oriented, flexible, resilient sides or lips 311 and 311*a*. These lips 311 and 311*a* form outer portions of the channel 308 and the sides 312 and 312*a* form inner portions of the channel 308. The lips 311 and 311*a* are disconnected from each other, with their respective adjacent inner ends E12 and E11 spaced apart to provide a gap 313. This gap 313 enables each lip 311 or 311*a* to flex independently upon connecting the corner connector 300 to the bed base 10. Each lip 311 and 311*a* includes one component, for example a tab 302, of a two-component catch member CM1. As discussed subsequently in detail, an alternate version of a two-component catch member, the catch member CM2, is depicted in FIGS. 18A and 18B.

The main body 301 includes a rear planar stiffening member 310, substantially parallel to the floor 308*a* and offset therefrom, attached behind and above the substantially orthogonally oriented, sides 312, enhancing the rigidity of the snap-on connector 300. Rounded edges ED1 connect the stiffening member 310 to the sides 312 and 312*a*. As shown in FIGS. 14A, 16, 17A, 17B, 18A, and 18*b* the channel 308 has a predetermined width $w_2$ that is substantially equal to the width $w_3$ of the shoulder support/stiffener 22 and 22*a*. Thus, the shoulder support/stiffener 22 and 22*a* fit snugly into the channel 308. When the snap-on corner connector 300 is installed and secured, the floor 308*a* engages the external surface of the shoulder support/stiffener 22 or 22*a*.

Figure 17A:
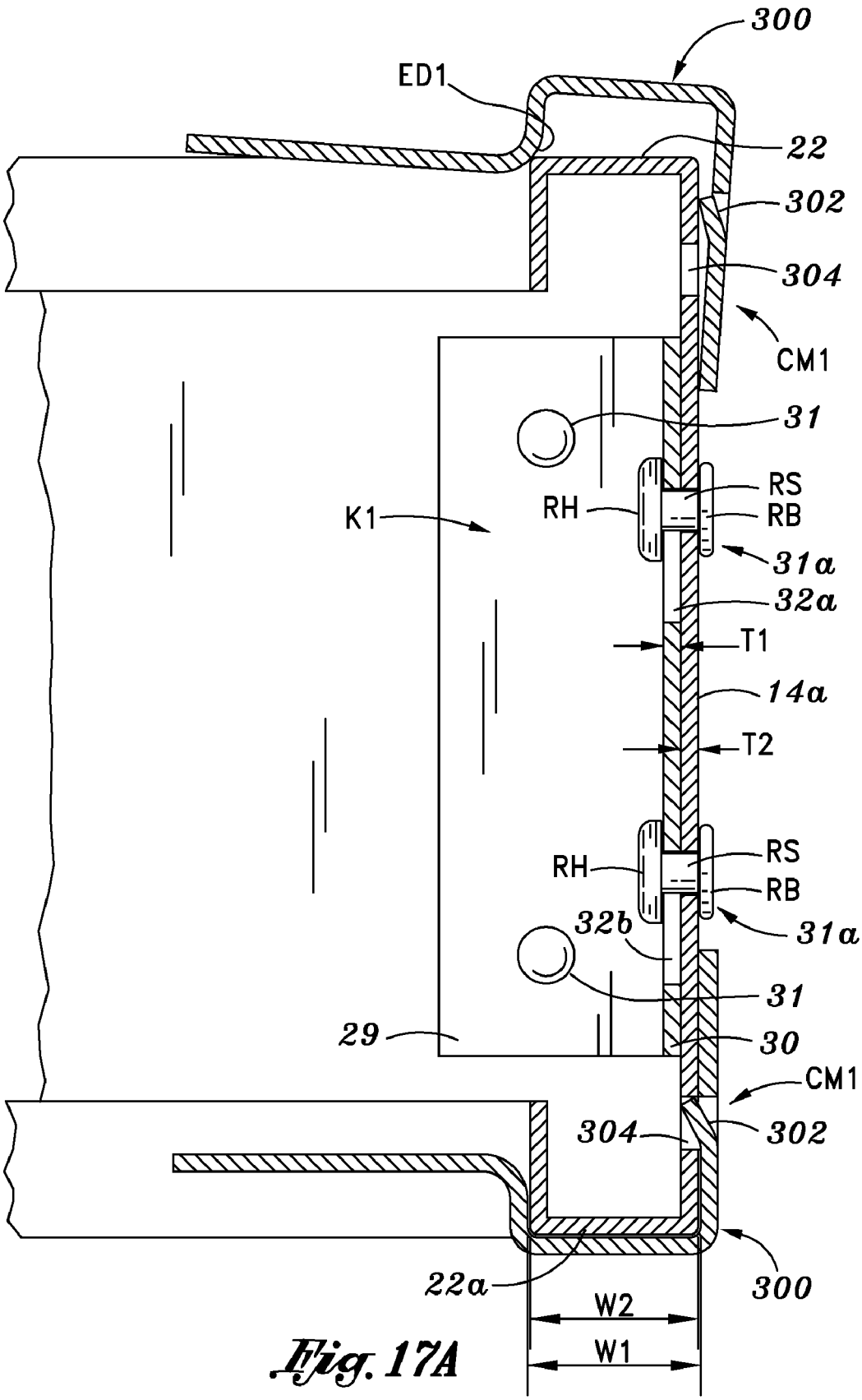
FIG. 17A is a cross-sectional view taken along line 17A-17A of FIG. 14 showing a bottom snap-on corner connector attached to the bed base and a top snap-on corner connector positioned to be attached to the bed base.
Figure 17B:
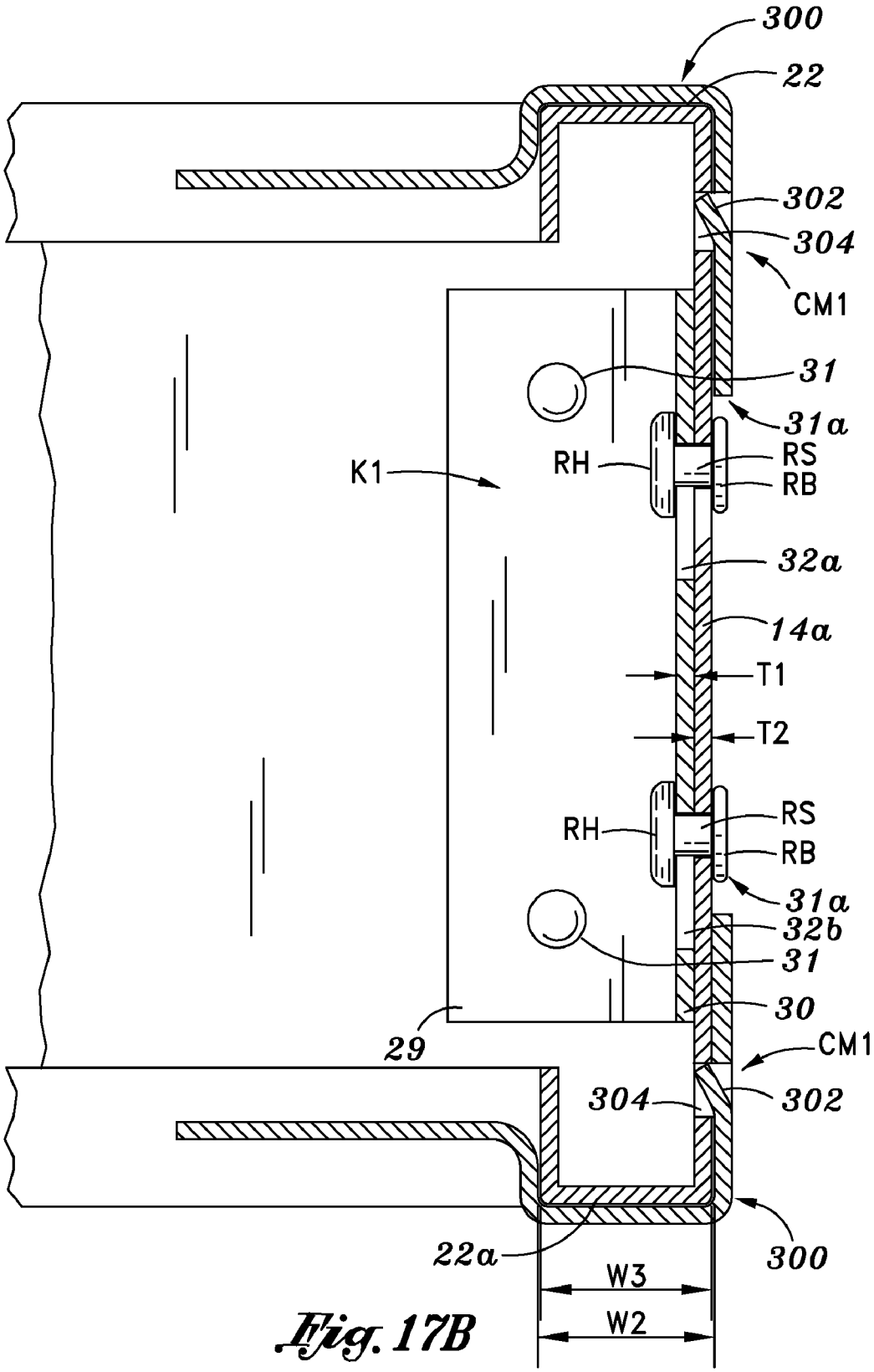
FIG. 17B is a cross-sectional view taken along line 17A-17A of FIG. 14 showing both the top and bottom snap-on corner connectors attached to the bed base.

The other component of the two-component catch member CM1 is a locking aperture 304 (FIG. 14A) in the planar portions C of the side members 12 and 14, 12*a* and 14*a*. The tabs 302 snap into the locking apertures 304 when connecting the corner connector 300 to the bed base 10 as depicted in FIGS. 17A and 17B. There is a pair of locking apertures 304 associated with each corner connector 300. The individual apertures 304 of each aperture pair are positioned with respect to the individual tabs 302 of each tab pair so that the apertures and tabs are aligned and in registration when the corner connector 300 is forced into a corner of the bed base 10.

The tabs 302 are resilient and function as springs. As depicted in FIGS. 17A and 17B, the tabs 302 are depressed inwardly as they slip over the shoulder support/stiffeners 22 and engage the upper part of the planar portions C of the side members 12*a* and 14*a*. The rounded edges ED1 slip over the rear of the shoulder support/stiffeners 22 as the corner connector 300 is pressed onto the corner of the bed base 10. The pair of depressed tabs 302, upon being moved into registration with the associated pair of locking apertures 304, flex outward and, due to their spring action, snap into the apertures, locking the snap-on corner connector 300 to the corner of the bed base 10. As shown in FIG. 17B the snap-on corner connector 300 is shown in its fully installed position. Upon alignment of the corner connector 300, on and into the ninety degree angle made by the pairs of side members 12 with 14, 12 with 14*a*, 12*a* with 14, and 12*a* with 14*a*, the snap-on corner connector 300 is snapped into place in each corner both top and bottom and locked together by the two-component catch member CM1.

The snap-on connector 400 (FIGS. 18A and 18B) provides an alternate embodiment of this invention using the catch member CM2. The catch member CM2 depicted in FIGS. 18A and 18B also employs the pair of tabs 302 and apertures 304, with their locations reversed. In this version, the tabs 302 are located in the planar portions C of the side members 12 and 12*a* and 14 and 14*a* and the apertures 304 are located in the lips 311 and 311*a*. The pair of tabs 302 in the portions C of the side members 12 and 12*a* and 14 and 14*a* are in registration with the pair of apertures 304 in the lips 311 and 311*a* upon connecting the snap-on connector 400 to the corner of the bed base 10. The resilient tabs 302 again flex inwardly, being depressed as they engage the inside surface of the lips 311 and 311*a*. The depressed tabs 302, upon moving into registration with the associated pair of locking apertures 304 in the lips 311 and 311*a*, flex outward and snap into the apertures, locking the snap-on corner connector 400 to the corner of the bed base 10. As shown in FIG. 18B the snap-on corner connector 400 is shown in its fully installed position. Upon alignment of the corner connector 400, on and into the ninety degree angle made by the pairs of side members 12 with 14, 12 with 14*a*, 12*a* with 14, and 12*a* with 14*a*, the snap-on corner connector 400 is snapped into place in each corner both top and bottom and locked together by the two-component catch member CM2.

Two-Component Connector

The alternate two-component connector 11*a* eliminates the locking component LK of the two-component connector 11. The two-component connector 11*a* may employ the hole 34 and the catch element 54 like that of the two-component connector 11.

Figure 19:
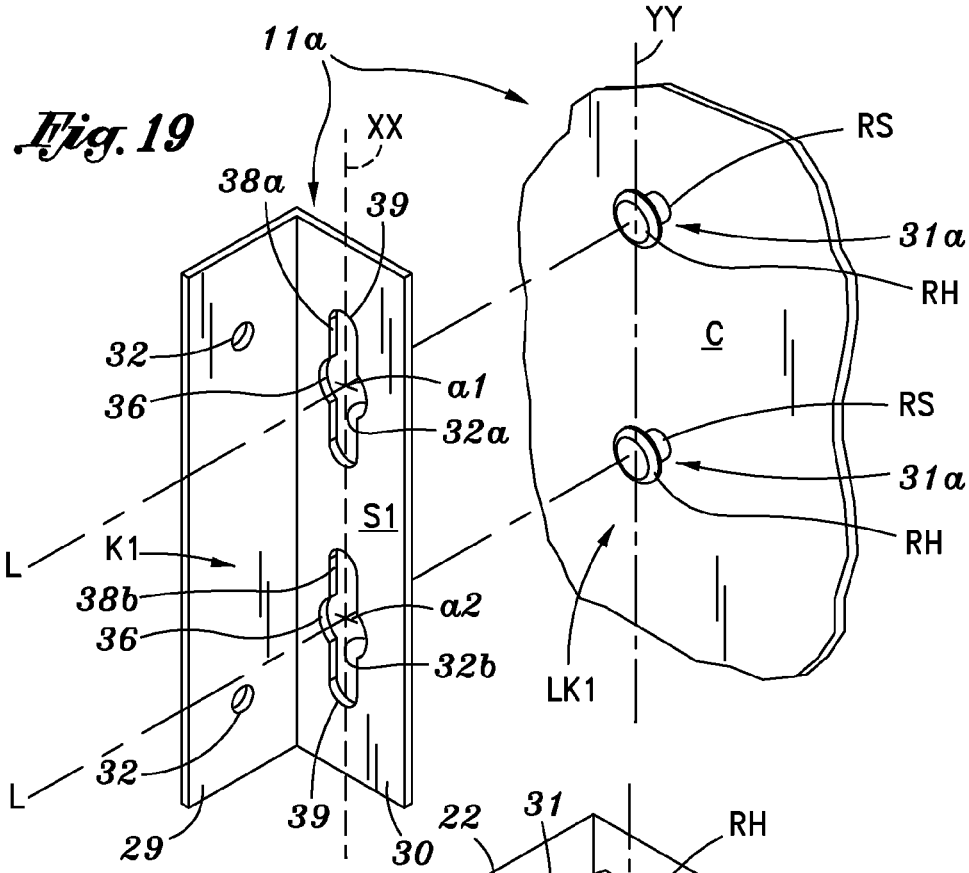
FIG. 19 is a perspective view of the alternate embodiment of the two-component connector prior to the components being connected to each other.

As best shown in FIG. 19, the two-component connector 11*a* has one component, a keyhole component K1 that is essentially identical to the keyhole component K shown in FIGS. 5 and 6. The second component of the alternate two-component connector 11*a* comprises a pair of shoulder rivets 31*a* that pass directly through the planar portions C of side members of the bed base 10, thereby eliminating the two plates 40 and 42 connected by a narrow section 44 depicted in FIG. 5. These shoulder rivets 31*a* function as a locking component LK1. The components K1 and LK1 are both attached respectively to the inside surfaces S of the planar portions C of the side members 12 and 14 (FIG. 20), so that they all face inwardly upon assembly of these side members to form a corner of the bed base 10. It is important that each locking component K1 and LK1 of the two-component connector 11*a* be positioned correctly on the side member to which it is attached so that they properly interconnect upon assembly of the adjacent side members.

Figure 20:
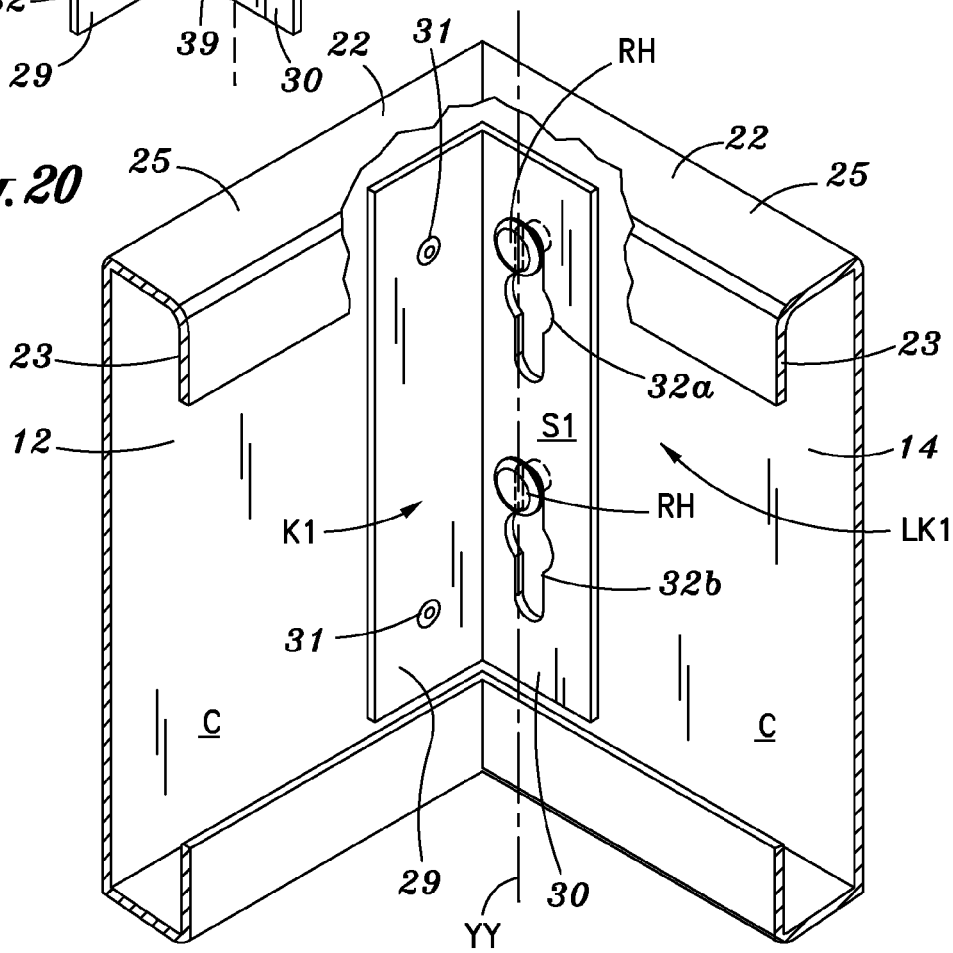
FIG. 20 is a perspective view of the two-component connector depicted in FIG. 19 after the components are connected to each other.

As illustrated in FIGS. 19 and 20, the keyhole component K1 is attached to the side 12 to fasten it securely to the inside of the planar portions C of the side member 12 in the same manner as discussed above in connection with the keyhole component K shown in FIGS. 5 and 6. Except for the hole 34, the keyhole component K1 is identical to the keyhole component K and the identical parts have been given the same numerals. The shoulder rivets 31*a* are located in the side 14 in a predetermined position relative to the keyhole component K1, to achieve the alignment of the sides 12 and 14 as shown in FIGS. 17A, 17B, 18A, and 18B upon connecting the keyhole component K1 to the shoulder rivets 31*a*. Specifically, the longitudinal, planar support platforms or legs 25 of the support/stiffeners 22 and 22*a* are essentially in the same horizontal plane when the keyhole component K1 and the locking component LK1 are connected together.

Each shoulder rivet 31*a* includes a shoulder rivet base RB, a narrow shaft RS, and an enlarged shoulder rivet head RH. As shown in FIG. 19 the pair of shoulder rivets 31*a* of the locking component LK1 extend outwardly from the inside surface of the planar portion C of a side member. The pair of shoulder rivets 31*a* forming the locking component LK1 are aligned along a longitudinal axis YY that is substantially at a right angle to the longitudinal axis L of the side member to which this pair of shoulder rivets are attached. The narrow shaft RS of each shoulder rivet 31*a* extends through the planar portion C so the enlarged head RH projects inward with the rivet base RB bearing against the outside surface of the planar portion C to secure the shoulder rivet 31*a*.

The dimensions of each shoulder rivet 31*a* forming the locking component LK1 insure proper attachment to the keyhole component K1. The shaft RS is sufficiently long to facilitate interconnecting the keyhole component K1 with the locking component LK1 by allowing the shaft RS to slide along either portion 38*a* or 38*b* while the head RH rides on the surface S1 of the leg 30 of the keyhole component K1. Each head RH is sized to pass through the central portion 36 of the symmetrically shaped openings 32*a* and 32*b* of the keyhole component K1, but is larger than the narrow portions 38*a* and 38*b*. The narrow shaft RS is sized to be received in the one of narrow portions 38*a* or 38*b* upon assembly of the bed base 10. As depicted in 17A, 17B, 18A, and 18B, the inner width T1 of the leg 30 of the keyhole component K1 plus the inner width T2 of a side member 14*a* equals the length of the shoulder rivet shaft RS. Thus, upon attaching the pair of rivets 31*a* that form the locking component LK1 to the keyhole component K1, the shoulder rivet's undersides abut and bear against the surface S1 of the leg 30 of the keyhole component K1.

The relative positions of the heads RH of each pair of shoulder rivets 31*a* forming the locking component LK1 with respect to the centers a1 and a2 of the openings 38*a* and 38*b* in the keyhole component K1 are the same as the heads H of the fingers 50 and 50*a* depicted in FIGS. 7A and 7B. Consequently, the relative distances d3, d4, d5, d7, and d8 are the same as discussed above in connection with FIGS. 7 and 7A for the two-component connector 11. This insures that the side members are properly aligned as depicted in FIG. 20 upon assembly of the keyhole component K1 and the locking component LK1 of the two-component connector 11*a*.

Scope of the Invention

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A bed base comprising four side members each having opposed edges and opposed ends, each said side member having at the opposed ends thereof one component of a self-locking two-component catch member, one of the components of the two-component catch member being a locking aperture and the other component being a tab, and four pairs of substantially identical, unitary corner connectors, each corner connector including outer and inner surfaces and a right angle shaped channel formed in the inner surface, said right angle shaped channel having predetermined width dimensions and formed by a pair of spaced apart substantially orthogonally oriented, flexible resilient sides forming outer portions of the channel, said sides being disconnected from each other to enable each side independently to flex and at least one of the sides including the other component of the two-component catch member, said side members and corner connectors assembled into a substantially rectangular structure with corners formed upon connecting the side members together with individual pairs of the corner connectors, one connector of each individual pair being at an individual corner and mounted along a top orthogonal corner edge of the bed base and the other connector of said individual pair being at said individual corner and mounted along a bottom orthogonal corner edge of the bed base, said top and bottom orthogonal corner edges having substantially the same identical width dimensions as the predetermined width dimensions of the right angle shaped channel in each corner connector, said right angle shaped channel of each said corner connector and one orthogonal corner edge being aligned and in registration with each other with an individual orthogonal corner edge being forced into an individual right angle shaped channel with relative movement of the corner and channel toward each other to flex outward the flexible resilient sides, each said tab being initially depressed when an individual orthogonal corner edge is forced into the right angle shaped channel and being aligned with the locking aperture to snap into said aperture upon being advanced with the relative movement of the corner and channel toward each other, said top and bottom orthogonal corner edges being substantially horizontal and said corner connectors of each said pair being positioned with their respective inner surfaces facing each other.

2. The bed base of claim 1 where the tab is resilient, functioning as a spring upon being depressed.

3. The bed base of claim 2 where each side member is made from a single metallic sheet using conventional metal bending and stamping techniques, and each corner connector is made from a single metallic sheet using conventional metal bending and stamping techniques.

* * * * *